US010631674B2

(12) United States Patent
Hafeznezami

(10) Patent No.: US 10,631,674 B2
(45) Date of Patent: Apr. 28, 2020

(54) ADJUSTABLE PILLOW AND METHODS OF MAKING AND USING SAME

(71) Applicant: Mohammad Hadi Hafeznezami, Cumming, GA (US)

(72) Inventor: Mohammad Hadi Hafeznezami, Cumming, GA (US)

( * ) Notice: Subject to any disclaimer, the term of this patent is extended or adjusted under 35 U.S.C. 154(b) by 0 days.

(21) Appl. No.: 16/417,768

(22) Filed: May 21, 2019

(65) Prior Publication Data

US 2019/0335928 A1 Nov. 7, 2019

Related U.S. Application Data

(63) Continuation of application No. 15/970,167, filed on May 3, 2018, now Pat. No. 10,321,776.

(60) Provisional application No. 62/564,748, filed on Sep. 28, 2017.

(51) Int. Cl.
*A47G 9/10* (2006.01)

(52) U.S. Cl.
CPC ..... *A47G 9/1081* (2013.01); *A47G 9/10* (2013.01)

(58) Field of Classification Search
CPC ..... A47G 9/10; A47G 9/0253
See application file for complete search history.

(56) References Cited

U.S. PATENT DOCUMENTS

| | | | | | |
|---|---|---|---|---|---|
| 823,930 | A * | 6/1906 | Coakley | A47G 9/0253 | 5/490 |
| 1,068,355 | A * | 7/1913 | McComb | A47G 9/10 | 5/640 |
| 2,500,974 | A * | 3/1950 | Angert | A47G 9/10 | 5/645 |
| 4,768,247 | A * | 9/1988 | Beier | A47G 9/0253 | 5/490 |
| 5,271,114 | A * | 12/1993 | Kjersem | A47G 9/0253 | 5/490 |
| 5,363,524 | A * | 11/1994 | Lang | A47G 9/1081 | 5/640 |
| 5,758,375 | A * | 6/1998 | Horowitz | A47G 9/10 | 5/640 |
| 9,427,087 | B2 * | 8/2016 | Clarke | A47C 7/383 | |
| 9,955,805 | B2 * | 5/2018 | Lou | A47G 9/1081 | |
| 9,980,587 | B2 * | 5/2018 | Miller | A47G 9/10 | |
| 2002/0138908 | A1 * | 10/2002 | Wang | A47G 9/10 | 5/636 |
| 2012/0073055 | A1 * | 3/2012 | Cupo | A47C 7/38 | 5/636 |
| 2015/0173535 | A1 * | 6/2015 | Reese | A47G 9/0253 | 5/490 |

* cited by examiner

*Primary Examiner* — Eric J Kurilla
(74) *Attorney, Agent, or Firm* — Ballard Spahr LLP

(57) ABSTRACT

A pillow allowing adjustment of the height, thereby minimizing neck muscles' strain and improving efficiency and quality of sleep is disclosed. The disclosed pillow contains a number of various compartments that are in communication with each other to allow adjustment of the height by the user.

12 Claims, 8 Drawing Sheets

ADJUSTABLE PILLOW AND METHODS OF MAKING AND USING SAME

CROSS REFERENCE TO RELATED APPLICATIONS

This application is a continuation of U.S. patent application Ser. No. 15/970,167, filed May 3, 2018, which claims the benefit of priority to U.S. provisional patent application Ser. No. 62/564,748, filed Sep. 28, 2017, which is hereby incorporated by reference herein in its entirety.

FIELD OF INVENTION

The present invention relates to an ergonomic adjustable pillow, and methods of making and using the same. In particular, this invention relates to a user friendly adjustable pillow that can be easily adjusted to various heights, minimizing neck muscle strain, and improving the efficiency and quality of sleep.

BACKGROUND

It is commonly understood that in order to increase an individual's comfort and reduce neck and back strain during resting time, the vertebrae of the individual's spine should be in neutral alignment during sleep. If a pillow provides neck support that is too high or too low, the vertebrae in the neck will be out of alignment with the vertebrae in the rest of the spine. This may reduce the restfulness of the individual's sleep and can aggravate neck and back problems. The level of neck support required for an individual can vary according to body size and sleeping position. Accordingly, it is desirable to have an adjustable neck support which can be quickly and easily adjusted by the individual while lying down. It is also desirable for the pillow to distribute the body weight of the individual to decrease compression on compression points. These features can increase comfort levels, and reduce neck and back strain.

One of the approaches to solving this problem was the development of visco-elastic foam, preformed into an orthopedically designed contour pillow that provided improved support for a user's head and neck. However, this technology suffers from at least two limitations. First, because the ideal level of neck support varies depending on the user's body size and sleeping position, a pre-formed visco-elastic pillow will not provide adequate neck support for all users in all sleeping positions. Secondly, because the visco-elastic foam molds to the individual, the support in the neck region may not be sufficiently firm.

Accordingly, there is still a need for an ergonomic pillow that allows neck support, which can be custom-adjusted to suit the user's individual needs and sleeping patterns. Still further there is a need for an ergonomic pillow that is simple to produce and is affordable.

SUMMARY

Described herein, in one aspect, is a pillow comprising: a) a cover comprising at least two adjacent compartments configured to be in open communication with each other; b) an amount of filler contained in at least one of the adjacent compartments; wherein each of the two adjacent compartments are defined by a top portion and a bottom portion, wherein the top portion has an internal top surface and an external top surface, and wherein the bottom portion has an internal bottom surface and an external bottom surface;

wherein the at least two adjacent compartments are configured to be releasably secured to each other with a first internal fastener located on the internal bottom surface and internal top surface of the each of the adjacent compartments, and wherein the first internal fastener comprises an opened and a closed position; wherein each of the adjacent compartments are releasably secured to each other with a first external fastener comprising an opened and a closed position, wherein the first external fastener is in the opened position the at least two adjacent compartments are at least partially separated from each other such that an opening is formed between the at least two adjacent compartments, and wherein the first external fastener is in the closed position, the opening formed between the at least two adjacent compartments is closed; and wherein access to the first internal fastener is allowed when the first external fastener is in the opened position.

In another aspect, the present disclosure describes a pillow cover comprising at least two adjacent compartments configured to be in open communication with each other; wherein each of the two of adjacent compartments are defined by a top portion and a bottom portion, wherein the top portion has an internal top surface and an external top surface, and wherein the bottom portion has an internal bottom surface and an external bottom surface; wherein the at least two adjacent compartments are configured to be releasably secured to each other with a first internal fastener located on the internal bottom surface and internal top surface of the each of the adjacent compartments, and wherein the first internal fastener comprises an opened and a closed position; wherein each of the adjacent compartments are releasably secured to each other with a first external fastener comprising an opened and a closed position, wherein the first external fastener is in the opened position the at least two adjacent compartments are at least partially separated from each other such that an opening is formed between the at least two adjacent compartments, and wherein the first external fastener is in the closed position, the opening formed between the at least two adjacent compartments is closed; and wherein access to the first internal fastener is allowed when the first external fastener is in the opened position, and wherein access to the first internal fastener is allowed when the first external fastener is in the opened position.

In another aspect, the present disclosure describes a pillow cover comprising a compartment defined by a top portion and a connected bottom portion, wherein the compartment comprises: i) a first section having a first length; and ii) at least one second section, adjacent to the first section along the axis of the first length wherein the first section and the at least one second section are configured to be releasably secured with a first external fastener; wherein the first external fastener has an opened and a closed position; wherein the top portion has an internal top surface and an external top surface, and wherein the bottom portion has an internal bottom surface and an external bottom surface; wherein the at least one second section is defined by a gusset comprising a fabric sheet having a second length that is inwardly folded toward the top and bottom inner surfaces of the cover when the first external fastener is in the closed position; and wherein the fabric sheet is unfolded along the first length of the first section when the first external fastener is in the open position, such that a length of the compartment is a combination of the first and the second length.

In yet other aspects described herein is a pillow comprising: a) a cover comprising a compartment defined by a top portion and a connected bottom portion, wherein the compartment comprises: i) a first section having a first length; and ii) at least one second section, adjacent to the first section along the axis of the first length, wherein the first section and the at least one second section are configured to be releasably secured with a first external fastener; wherein the first external fastener has an opened and a closed position; wherein the top portion has an internal top surface and an external top surface, and wherein the bottom portion has an internal bottom surface and an external bottom surface; wherein the at least one second section is defined by a gusset comprising a fabric sheet having a second length that is inwardly folded toward the top and bottom inner surfaces of the cover when the first external fastener is in the closed position; and wherein the fabric sheet is unfolded along the first length of the first section when the first external fastener is in the open position, such that a length of the compartment is a combination of the first and the second length; and b) an amount of filler.

Additional aspects of the invention will be set forth, in part, in the detailed description, figures, and claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE FIGURES

These and other features of the preferred embodiments of the invention will become more apparent in the detailed description in which reference is made to the appended drawings wherein.

DETAILED DESCRIPTION

Figure 1:
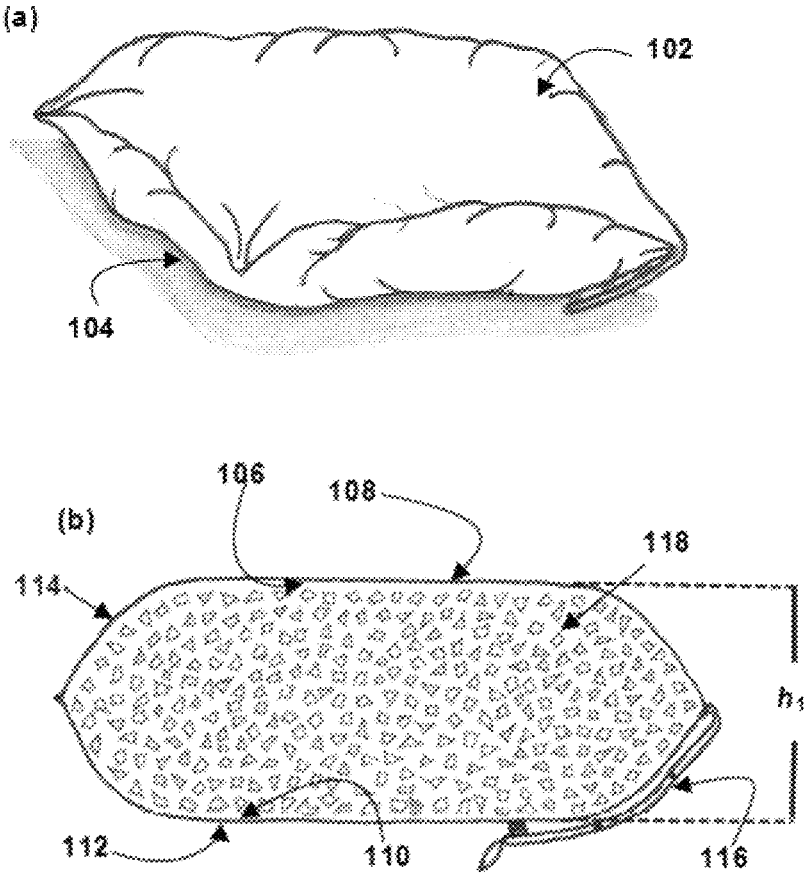
FIG. 1 depicts (a) a perspective view and (b) a longitudinal cross section of an adjustable pillow having a first height, in accordance with various aspects of the present disclosure.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

A. Definitions

As used throughout, the singular forms "a," "an" and "the" include plural referents unless the context clearly dictates otherwise. Thus, for example, reference to "a compartment" can include two or more such compartments, unless the context indicates otherwise.

Throughout the description and claims of this specification the word "comprise" and other forms of the word, such as "comprising" and "comprises," means including but not limited to, and is not intended to exclude, for example, other additives, components, integers, or steps. Furthermore, it is to be understood that the terms comprise, comprising and comprises as they related to various aspects, elements and features of the disclosed invention also include the more limited aspects of "consisting essentially of" and "consisting of."

Ranges can be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described feature, event or circumstance may or may not occur, and that the description includes instances where said feature, event or circumstance occurs and instances where it does not.

The word "or" as used herein means any one member of a particular list and also includes any combination of members of that list.

As used herein, and unless the context clearly indicates otherwise, the term "pillow" is used generically and includes any article comprising a fabric cover, sometimes referred to as a pillow cover, and optionally comprising a filler, that can be used to support a user's position during a resting period. References and descriptions of a pillow including filler are also intended to refer to embodiments of the pillow cover itself without comprising filler. It is understood that, as described herein, the pillow can provide support of the body at rest for comfort, therapeutic benefit, decoration, or play. Pillows of the current invention include all types of pillows that are designed to support the body when lying down, sitting, or both. It is understood that such pillows include but are not limited to neck pillows, body pillows, lumbar pillows; decorative pillows, cushions, and the like.

B. Pillow

Disclosed herein is a pillow comprising: a) a cover comprising at least two adjacent compartments configured to be in open communication with each other; b) an amount of filler contained in at least one of the adjacent compartments; wherein each of the two adjacent compartments are defined by a top portion and a bottom portion, wherein the top portion has an internal top surface and an external top surface, and wherein the bottom portion has an internal bottom surface and an external bottom surface; wherein the at least two adjacent compartments are configured to be releasably secured to each other with a first internal fastener located on the internal bottom surface and internal top surface of the each of the adjacent compartments, and wherein the first internal fastener comprises an opened and a closed position; wherein each of the adjacent compartments are releasably secured to each other with a first external fastener comprising an opened and a closed position, wherein the first external fastener is in the opened position the at least two adjacent compartments are at least partially separated from each other such that an opening is formed between the at least two adjacent compartments, and wherein the first external fastener is in the closed position, the opening formed between the at least two adjacent compartments is closed; and wherein access to the first internal fastener is allowed when the first external fastener is in the opened position.

In some aspects, an exemplary inventive pillow is shown in FIG. 1. FIG. 1(*a*) depicts a general view of the exemplary pillow having a top portion 102 and a bottom portion 104. FIG. 1(*b*) shows a cross-section view of the exemplary pillow having an internal top surface 106, external top surface 108, internal bottom surface 110, and external bottom surface 112. The cover of at least one of the adjacent compartments 114 contains an amount of filler 118. The cover further comprises at least one additional adjacent compartment 116. In this exemplary aspect, the pillow has a first height $h_1$.

Figure 2:
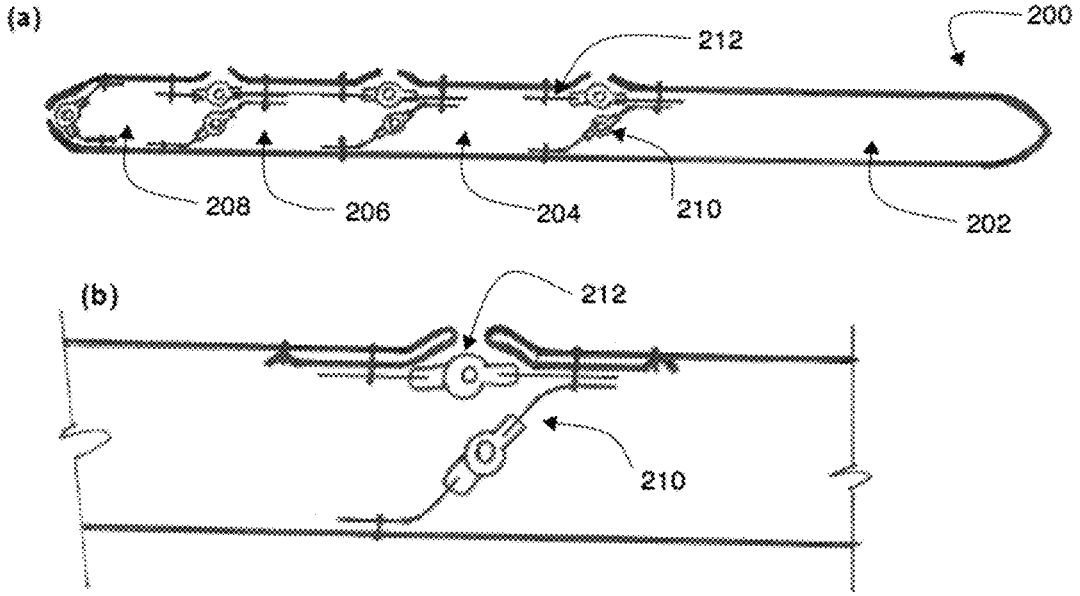
FIG. 2 depicts (a) a plurality of external and internal fasteners and (b) a close up of an external and internal fastener, in accordance with various aspects of the present disclosure.

It is understood that in some exemplary aspects, the at least two adjacent compartments are configured to be releasably secured to each other. FIG. 2(*a*) shows an exemplary cover 200 having at least one compartment 202 that is releasably secured to at least another adjacent compartment 204, that is releasably secured to a third compartment 206, that is further releasably secured to a fourth compartment 208. It is understood that a number of compartments, for example, two, three, four, five, six, seven, eight, or more compartments, can be readily determined by one of ordinary skill in the art depending on the specific application. The at least two adjacent compartment are releasably secured to each other with a first internal fastener 210 located on the internal bottom surface and the internal top surface of the each of the adjacent compartments. In still further aspects, each of the adjacent compartments can be also releasably secured to each other with the first external fastener 212. It is understood that the first external fastener is configured in such way that when the first external fastener 212 is in the opened position, for example, compartment 202 is at least partially separated from the compartment 204 forming an opening between these two compartments. It is further understood that when the first external fastener 212 is in the closed position, the opening between compartment 202 and 204 is closed. It is further understood that the access to the first internal fastener is allowed when the first external fastener is in the opened position.

In certain aspects, the at least two adjacent compartments are in open communication with each other when the internal fastener 210 is in opened position and the external fastener 212 is in the closed position. It is understood that in aspects when the internal fastener 210 and external fastener 212 are in the closed position, the amount of filler present in the cover is located in the first compartment, and thus, defines a first height $h_1$ (as shown in FIG. 1(*a*)) of the pillow. In other words, in the aspects wherein the first internal fastener is in the closed position, the first of the at least two compartments comprises the amount of filler and the pillow has a first height. FIG. 2(*b*) illustrates a close-up view of the first internal fastener 210 and the first external fastener 212, where both fasteners are in the closed position.

Figure 3:
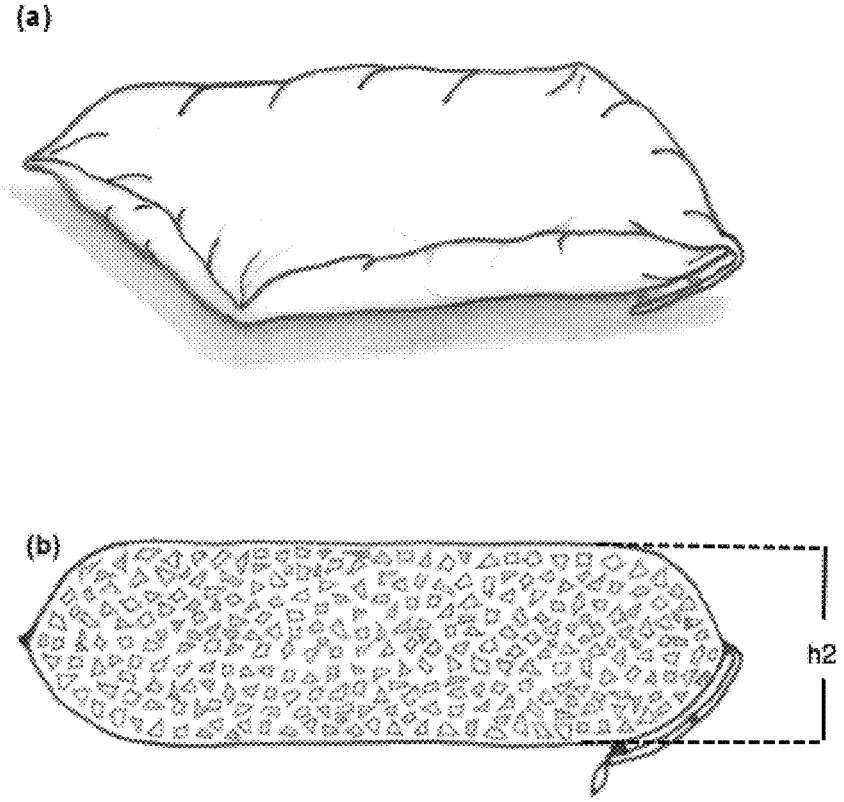
FIG. 3 depicts (a) a perspective view and (b) a longitudinal cross section of an adjustable pillow having a second height, in accordance with various aspects of the present disclosure.

In other aspects, to access the first internal fastener 210, the user first needs to open the external fastener 212. It is understood that the external fastener is easily accessible from the external surface of the bottom portion. It is further understood that the external fastener 212 needs to be closed in order to isolate or contain the filler in the at least one or more adjacent compartments from the surrounding environment. In the aspects wherein the first internal fastener is opened, the first and a second of the at least two compartments can each comprise a portion of the amount of the filler. In other words, in such exemplary aspects, the initial amount of the filler is distributed between the at least two adjacent compartments. Such an exemplary aspect is shown in FIGS. 3(*a*) and 3(*b*). It is further understood that in this exemplary aspect, the first internal fastener is in the opened position and the first external fastener is in the closed position, and the pillow has a second height $h_2$. In certain aspects, and as it would be appreciated by one of ordinary skill in the art, the second height $h_2$ is lower than the first height $h_1$ It is further understood that the amount of filler can be distributed uniformly between these two adjacent compartments that are in open communication with each other.

Figure 4:
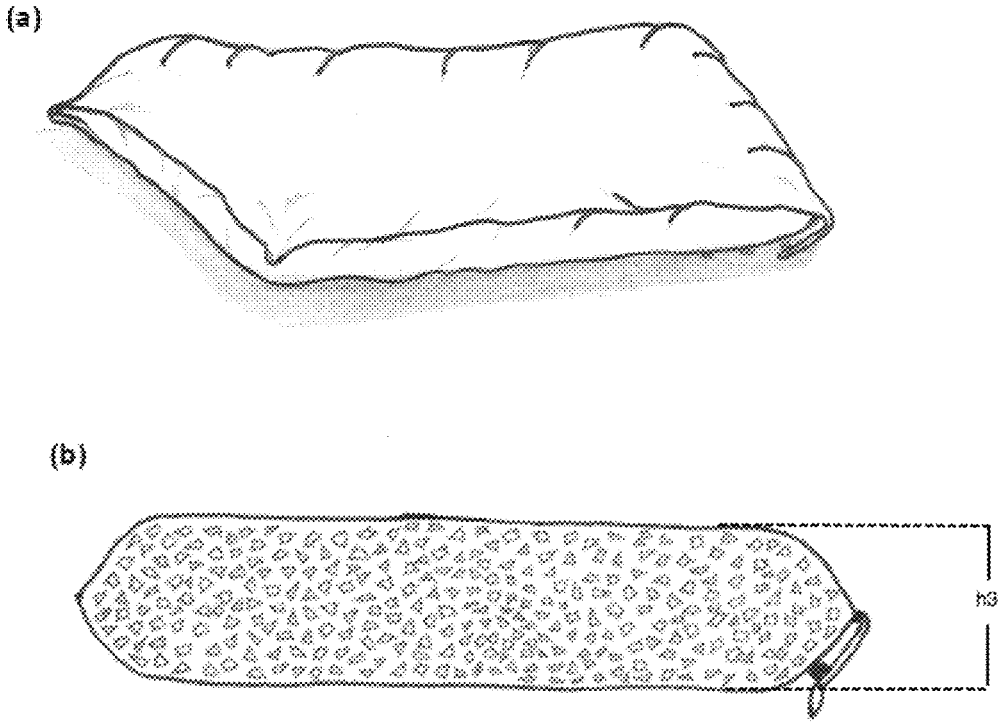
FIG. 4 depicts (a) a perspective view and (b) a longitudinal cross section of an adjustable pillow having a third height, in accordance with various aspects of the present disclosure.

In yet other aspects, the pillow can further comprise a third compartment as shown in FIG. 2 and FIG. 4. In such exemplary aspects, the pillow described herein comprises a cover that can have a third compartment, wherein the third compartment is configured to be releasably secured with the second compartment with a second internal fastener and with a second external fastener, wherein the second internal fastener and the second external fastener each comprises an opened and a closed position; and wherein an access to the second internal fastener is allowed when the second external fastener is in the opened position.

FIG. 4 shows exemplary aspects wherein both the second and the third compartments are in open communication with the first compartment and with each other. In the aspects where the each of the compartments are in the open communication with each other, the first and the second internal fasteners are in the opened position, while the first and the second external fasteners are in the closed positions. In such aspects, each of the compartments present in the cover comprises a portion of the amount of the filler and the pillow has a third height $h_3$ as shown in FIG. 4. It is further understood that the third height is lower than the second height. It is further understood that in such exemplary aspects, the initial amount of the filler is distributed between all compartments thereby reducing the height of the pillow. In yet other aspects, the third height is lower than the first height. In still further aspects, the third height is lower than the second and the first height. It is further understood that the amount of filler present in these aspects can be homogeneously distributed between all compartments.

Figure 5:
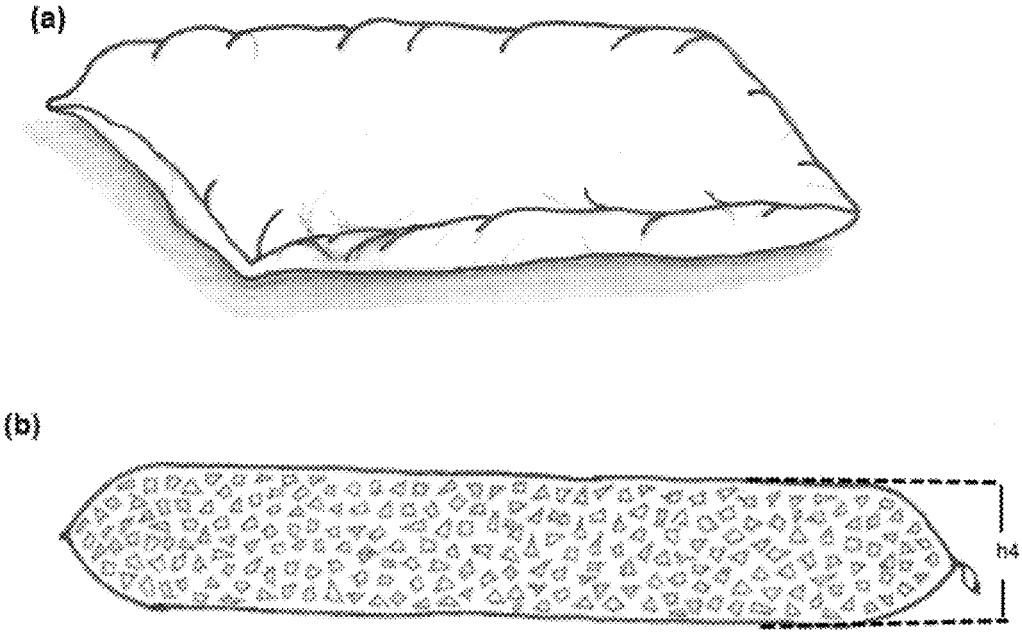
FIG. 5 depicts (a) a perspective view and (b) a longitudinal cross section of an adjustable pillow having a fourth height, in accordance with various aspects of the present disclosure.

It is further understood that additional compartments can be present. In some exemplary aspects and as shown in FIG. 2 and FIG. 5, the cover can comprise a fourth compartment. In such aspects, the cover comprises a first, a second, a third, and a fourth internal fastener and a first, a second, a third, and a fourth external fastener. In the aspects where each of the compartments is in open communication with each other, the first, the second, the third, and the fourth internal fasteners are in the opened positions while the first, the second, the third, and the fourth external fasteners are in the closed positions. In such aspects, the pillow has a height $h_4$ as shown in FIG. 5.

Figure 6:
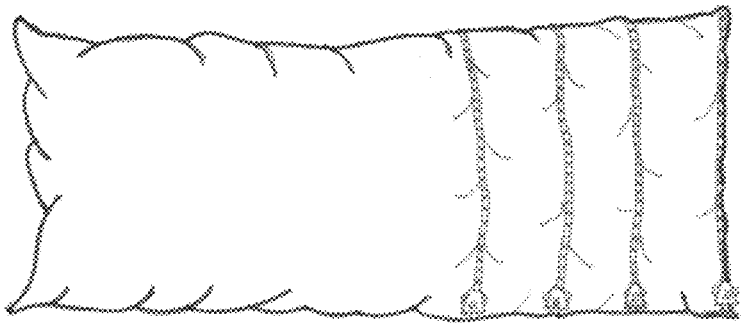
FIG. 6 depicts a top view of a bottom portion of an adjustable pillow having a fourth height, in accordance with various aspects of the present disclosure.
Figure 7:
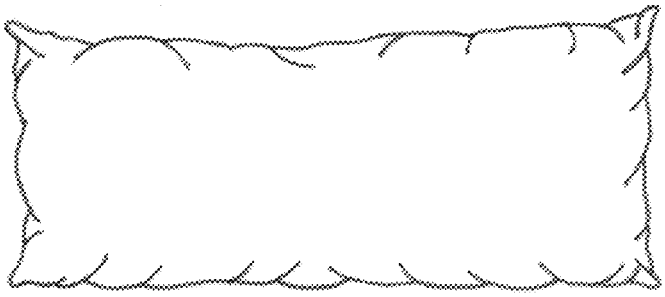
FIG. 7 depicts a top view of a top portion of an adjustable pillow having a fourth height, in accordance with various aspects of the present disclosure.
Figure 8:
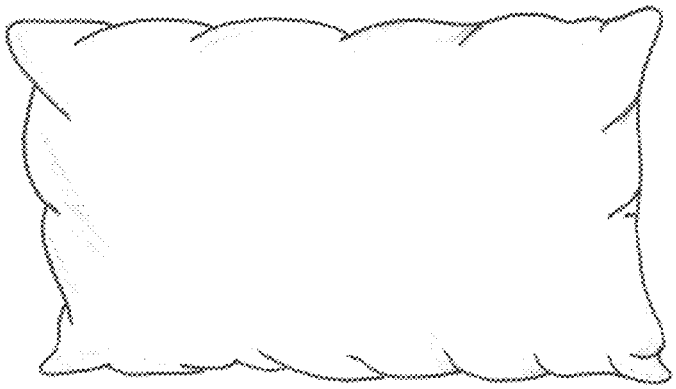
FIG. 8 depicts a top portion or a bottom portion of an adjustable pillow to be used inside of a pillow case, in accordance with various aspects of the present disclosure.

FIG. 6 and FIG. 7 each illustrate exemplary pillows in which all compartments are in open communication with each other. For example, FIG. 6 illustrates a bottom portion of the pillow where the first, the second, the third, and the fourth external fasteners are shown to be in the closed position. FIG. 7 shows a top portion of the same exemplary pillow. As one of ordinary skill in the art would readily appreciate, since the fasteners are located on the bottom portion of the pillow, the fasteners do not provide any discomfort for the user. However, it should also be understood that a user may turn the pillow such that the bottom portion of the pillow becomes the top portion of the pillow. If one of ordinary skill in the art is concerned with the decorative aspects of the pillow, it is contemplated that an additional decorative pillow cover can be used to hide the fasteners from the open view (as shown in FIG. 8). It should also be understood that the terms top and bottom, as used in this disclosure, are only intended to distinguish elements from each other when the pillow is oriented in a specific manner; that a pillow can be positioned or turned in any direction; and that the terms top and bottom are not intended to be limiting in any manner, for example, where a pillow is required to be oriented in any particular direction.

It is understood that a pillow, as disclosed herein, can have any number of compartments depending on a specific application. In certain aspects, each of the compartments has a predetermined length. In some aspects, the first compartment can have a length similar to a standard twin-size pillow. In yet other aspects, the first compartment can have a length similar to a standard queen-size pillow. In yet other aspects, any subsequent compartment can have a length equal to or shorter than that of the first of the at least two adjacent compartments. In still further aspects, each of the subsequent compartments can have the same length. In yet other aspects, each of the subsequent compartments can have a different length. It is understood that the length of the each of the subsequent compartment can be determined by one of ordinary skill in the art depending on the specific application. It is further understood that the length of the pillow can comprise the combination of the length of the first of the at least two adjacent compartments and the length of the any other subsequent compartment that is in open communication with each other. In still further aspects, the total length of the pillow can be any length known in the art or predetermined by the skilled practitioner. In still further aspects, the length of each subsequent compartment can be from about 1 to about 4 inches, including exemplary values of about 1.5 inches, about 2 inches, about 2.5 inches, about 3 inches, and about 3.5 inches or more. In certain unlimiting aspects, the total length of the pillow can be, for example, the length of the standard king size pillow.

It is further understood that in aspects where some of the compartments are not utilized and are not in open communication with each other, such compartments can be folded and attached to the bottom portion of the cover with a suitable fastener (as illustrated in FIG. 1, FIG. 3 and FIG. 4).

It is further understood that the user can adjust the pillow height by moving the filler between the different compartments at any time. For example and without limitation, if the user wants to decrease the height of the pillow to improve his comfort, the adjacent compartments can be transitioned to be in opened communication by putting the internal fasteners in the opened position and distributing the filler between the compartments. In yet other aspects, if the user wants to increase the height of the pillow, the user can move the filler to any number of compartments that suit his comfort level at that time and then close the respective internal fasteners to keep the filler in the desired compartments.

In yet other aspects, disclosed herein is pillow comprising: a) a cover comprising a compartment defined by a top portion and a connected bottom portion, wherein the compartment comprises: i) a first section having a first length; and ii) at least one second section, adjacent to the first section along the axis of the first length, wherein the first section and the at least one second section are configured to be releasably secured with a first external fastener; wherein the first external fastener has an opened and a closed position; wherein the top portion has an internal top surface and an external top surface, and wherein the bottom portion has an internal bottom surface and an external bottom surface; wherein the at least one second section is defined by a gusset comprising a fabric sheet having a second length that is inwardly folded toward the top and bottom inner surfaces of the cover when the first external fastener is in the closed position; and wherein the fabric sheet is unfolded along the first length of the first section when the first external fastener is in the open position, such that a length of the compartment is a combination of the first and the second length; and b) an amount of filler.

Figure 9:
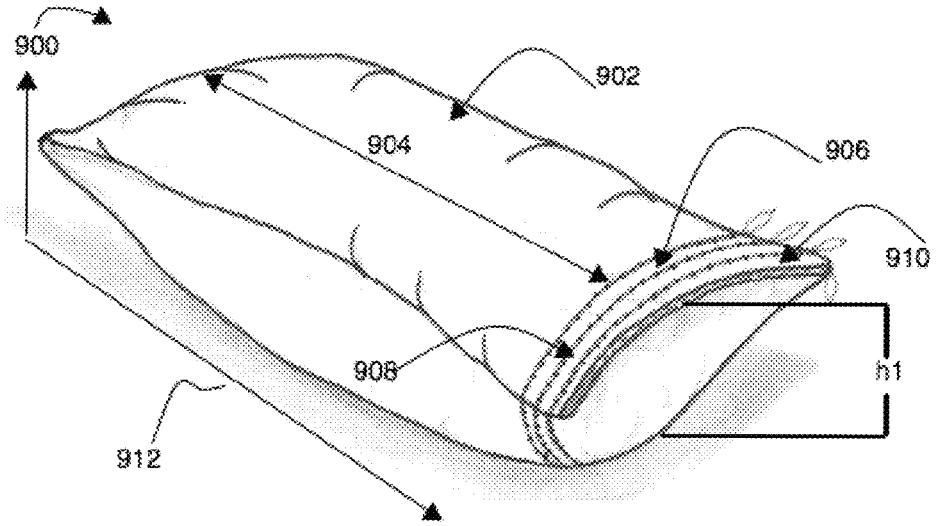
FIG. 9 depicts a perspective view of an adjustable pillow having a first height, in accordance with various aspects of the present disclosure.

FIG. 9 illustrates an exemplary pillow comprising a cover 900 comprising a first section 902 having a first length 904, and a number of the sections 906, 908, and 910, adjacent to the first section 902 along the axis 912 of the first length 904.

Figure 10:
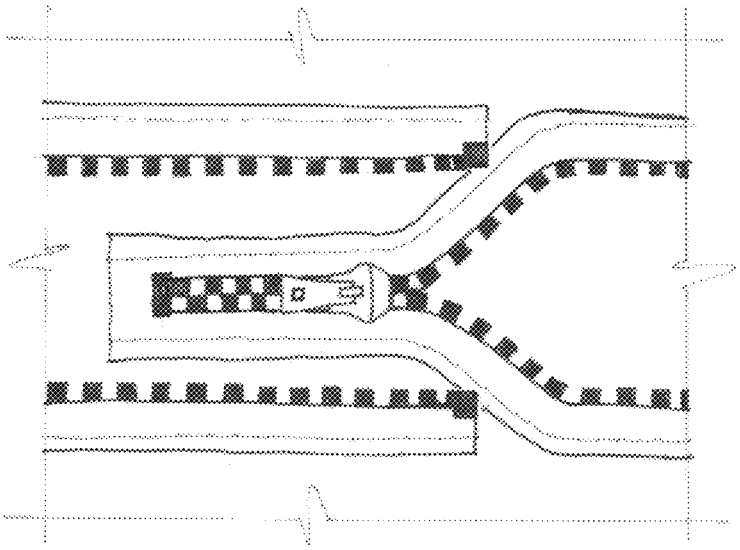
FIG. 10 depicts an enlarged detail of a first external fastener used in one embodiment.

In certain aspects, the first external fastener is located along a width of the cover and is configured to form an opening between the first section and the at least one second section when is in the opened position. In certain aspects, the first external fastener is located along the circumference of the cover. FIG. 10 depicts an enlarged detail of an exemplary first external fastener.

It is understood that when the first external fastener is in the closed position, the first section comprises the amount of filler and the pillow has a first height as shown in FIG. 9.

Figure 11:
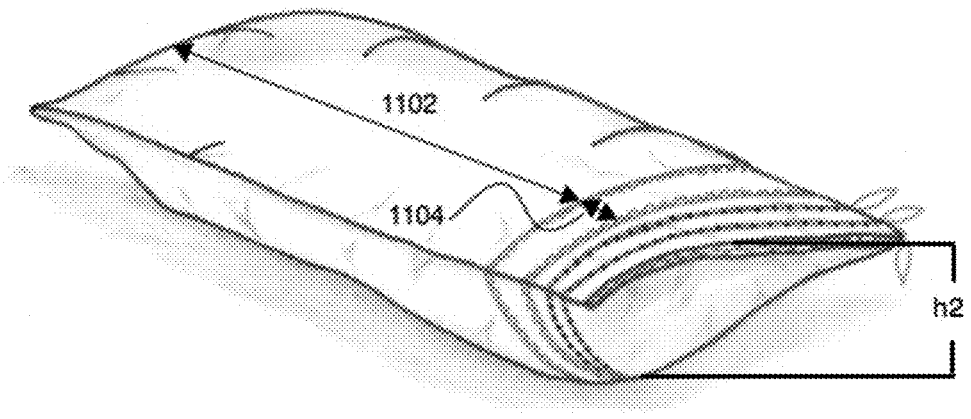
FIG. 11 depicts a perspective view of an adjustable pillow having a second height, in accordance with various aspects of the present disclosure.

In some aspects, the at least one second section is defined by a gusset comprising a fabric sheet having a second length that is inwardly folded toward the top and bottom inner surfaces of the cover when the first external fastener is in the closed position. When the first external fastener is in the opened position, the fabric of the at least one second section is unfolded along the first length of the first section such that the total length of the cover becomes a combination of the first 1102 and the second length 1104, as shown in FIG. 11. In such aspects, the amount of filler is distributed between the first and the at least one second sections and provides a pillow having a second height $h_2$, as shown in FIG. 11. It is further understood that the second height $h_2$ is lower than a first height $h_1$.

Figure 12:
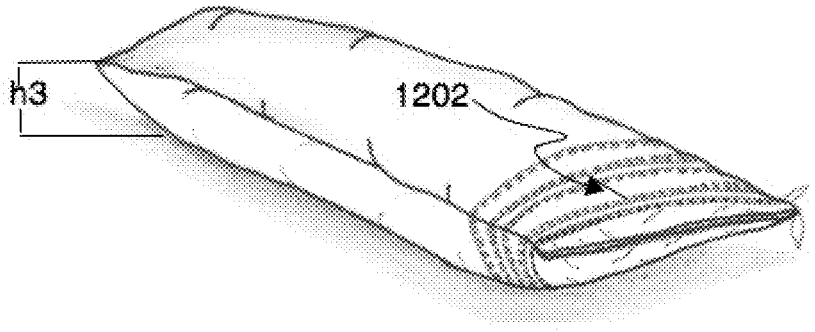
FIG. 12 depicts a perspective view of an adjustable pillow having a third height, in accordance with various aspects of the present disclosure.
Figure 13:
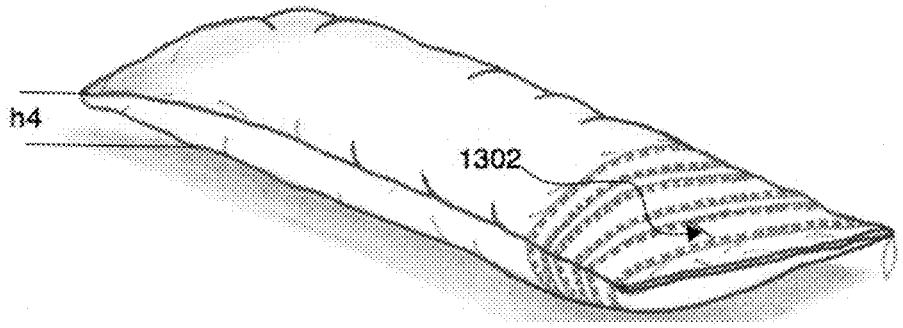
FIG. 13 depicts a perspective view of an adjustable pillow having a fourth height, in accordance with various aspects of the present disclosure.

In yet other exemplary aspects and as depicted in FIG. 12 and FIG. 13, the cover can comprise more sections connected to the first section. These sections can be releasably secured to each other with a second and a third external fastener. Each of these sections can have a third 1202 and a fourth length 1302 respectively. It is understood that in some aspects, the second, the third, and the fourth length are all the same. In yet other aspects, some of the lengths are the same and some are different. In still further aspects, all the lengths are different. For example and without limitation, the first length is longer than the second length, the third length, or the fourth length. In yet other exemplary aspects, the second length is longer than the third length. In still further exemplary and not limiting aspects, the second length is shorter than the fourth length. It is understood that the second length can be shorter than the third length, while the third length can be either shorter or longer than the fourth length. In yet other exemplary and not limiting aspects, the second length, the third length, and the fourth length are the same. In still further aspects, the length of each of the second sections can be from about 1 inch to about 4 inches, including exemplary values of about 1.5 inches, about 2 inches, about 2.5 inches, about 3 inches, and about 3.5 inches. It is understood that the length of each section can be easily determined by one of ordinary skill in the art depending on the specific application or needed esthetics.

In certain aspects where the second external fastener is open, the amount of filler is distributed between the first section and each of the subsequent sections that are in open communication with each other, such that the pillow has a height $h_3$ as shown in FIG. 12 or $h_4$ as shown in FIG. 13. It is understood that the optimal height is easily determined by the user depending on his sleep and resting patterns, and can be changed at any time.

It is understood that the top portion of the cover can be connected to the bottom portion of the cover by any known in the art methods. In some aspects, the connection is releasable. In yet other aspects, the connection is permanent.

In certain aspects, the cover comprises a fabric. In some aspects, the top portion of the cover and the bottom portion of the cover are made of the same continuous fabric. It is understood that the fabric can be any fabric known in the art, for example and without limitation the fabric can comprise textile, non-woven material, can be natural e.g., cotton or synthetic (polyester, nylon, or a blend or a combination thereof; it can also be non-woven synthetic or polymeric material; it can be breathable/permeable and the like. In yet other aspects, the top portion of the cover and the bottom portion of the cover are made of at least two pieces of the fabric. In such aspects, each piece of the at least two pieces of the fabric can be the same or different. It is understood that when each piece of the at least two pieces of the fabric is different from each other, the difference can be exhibited in the type of fabric, color, thickness, length, and the like. It is further understood that the fabric utilized in this disclosure can be easily available to one of ordinary skill in the art and can be chosen depending on an appropriate use.

It is understood that in certain aspects, the disclosed pillow can have any shape known in the art. In certain aspects, the pillow has a rectangular form. In yet other aspects, the pillow has a square form. It is further understood that in some aspects, the pillow can have any size known in the art and can be adjusted to fit a standard pillow cases. In yet other aspects, the pillow can have a non-standard size made to an order.

C. Fasteners

It is understood that the fasteners described herein can comprise any fasteners known in the art. In some aspects, the fasteners can comprise a zipper, a hook and loop, a button, a snap, a hook and eye, a magnet, a grommet, a lace, a fabric tie, or any combination thereof. It is understood that in some aspects, the fasteners present in the inventive pillow are the same, while in the other aspects the fasteners are different. In certain aspects, the fasteners can have any additional esthetic or functional attributes. In certain aspects, the fasteners can further comprise a specific case designed to hide the fastener from view or make the fastener more suitable for use. For example and without any limitations, the fasteners can comprise cushion materials designed to improve the feel for the user and decrease any discomfort that might be present due to the fastener. In certain aspects, the fasteners disclosed herein can comprise any means for releasably securing one or more compartments or sections. It is further understood that various fasteners are known and available to one of ordinary skill in the art. It is understood that ordinary skill in the art can easily chose a specific type of fasteners depending on specific application, design and esthetics.

It is understood that all fasteners can be same or different. In some aspects, all internal fasteners are the same. In yet other aspects, all internal fasteners are different. In still other aspects, all external fasteners are the same. In yet some other aspects, all external fasteners are different. It is understood that the external and internal fasteners can be the same of different. It is further understood that the types of fasteners used in the inventive pillow or cover can be chosen by one of ordinary skill in the art depending on the specific application.

It is understood that the fasteners used herein as used to secure adjacent compartments. In some aspects, fasters are secured to the fabric by any known in the art means, for example, and without limitation, by sewing, stapling, gluing, and the like. In some aspects, the external fasteners are located in such way that it allows an easy access to the external fasteners, while providing a sufficient esthetic and comfort level. In some aspects, the fastener can comprise at least two parts. In such exemplary aspects, at least one part of the fastener is located on one of the adjacent compartments, wherein the other part is located on a second of the adjacent compartments. In some aspects, for example, each of the parts of the external fastener can be located either on the internal surface of the bottom portion or on the external surface of the bottom portion. It is understood that the exact location of the fastener can be easily determined by one of the ordinary skill in the art depending on a specific application. In some exemplary aspects, the fastener can be a zipper. In such aspect, for example in a case of the external fasteners, one portion of the zipper is located on either internal or external surface of the bottom portion of one compartment, while another portion of the zipper is located on either internal or external surface of the bottom portion of the second of the adjacent compartments. In aspects where the external fastener is a hook and loop, for example, a hook is located on either internal or external surface of the bottom portion of one compartment, while a loop is located on either internal or external surface of the bottom portion of the second of the adjacent compartments.

It is further understood that one of ordinary skill in the art can use any additional attachments and/or accessories that can serve for esthetic purposes. For example, in aspects where one would desire to cover the external fastener from the user's eye, a decorative fabric or a special pocket can be utilized. It is understood that such additional covers, attachments or accessories can be easily added and adjusted by one of ordinary skill in the art depending on a desired application and user's preferences.

D. Fillers

The inventive pillow can optionally comprise any filler material known in the art. In certain aspects, the filler can comprise feathers, down, down alternative, foam, shredded memory foam, microbeads, natural and/or synthetic fibers, husks, or any combination thereof. In still further aspects, the filler can comprise a particulate material. In certain and unlimiting aspects, the microbeads can comprise beads of a micrometer size of unexpanded polystyrene material. In yet other exemplary and unlimiting aspects, the husks present in the filler can be obtained from buckwheat seed. It is understood that the filler material can be determined by the level of support provided by the pillow and can be chosen by one of ordinary skill in the art depending on the specific application. It is understood that the fillers are known and available to one of ordinary skill in the art and can be easily chosen based on the specific application.

In still further aspects, the filler can be optionally placed in a specifically designed bladder. In such aspects, the bladder can be made of any material that can be shaped to adjust to specific compartments or sections to ensure that the filler, while contained in the bladder, can be distributed between the compartments or section when needed.

E. Methods

It is understood that the inventive pillow disclosed herein can be prepared by any methods known in the art. It is further understood that the pillow cover can be made of any material known in the art. In some aspects, the cover is made of a fabric. In certain aspects, the fabric is made of natural fibers. In yet other aspects, the fiber is made of synthetic fibers.

In still further aspects, the at least two adjacent compartments are sewn to each other in at least one point of contact to provide at least one un-releasable connection. In still further aspects, the at least two adjacent compartments are connected to each other in at least one point of contact by any known in the art methods to provide at least one un-releasable connection.

In certain aspects, the internal fastener is attached to the internal bottom portion and the internal top portion of the cover. In such aspects, the internal fastener is hidden from the user's view. In some aspects, access to the internal fastener is provided to the user by putting the external fastener in the opened position. The external fasteners can be connected to either internal or external surface of the bottom portion of the each compartment allowing a connection between each adjacent compartment.

In other aspects, where only external fasteners are present and are used to connect various section of the pillow, the external fasteners are connected to the external surface of the cover along the circumference of the cover. In such aspects, when the external fasteners are opened, the folded gussets can be unfolded to increase the overall length of the pillow while reducing the height.

While certain exemplary aspects of the invention have been described and disclosed, it will be apparent to those skilled in the art that various changes and modifications may be made that will achieve some or even all of the advantages of the invention without departing from the spirit and scope of the invention.

Aspects

In view of the described pillow, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language and formulas literally used therein.

Aspect 1: A pillow comprising: a) a cover comprising at least two adjacent compartments configured to be in open communication with each other; b) an amount of filler contained in at least one of the adjacent compartments; wherein each of the two adjacent compartments are defined by a top portion and a bottom portion, wherein the top portion has an internal top surface and an external top surface, and wherein the bottom portion has an internal bottom surface and an external bottom surface; wherein the at least two adjacent compartments are configured to be releasably secured to each other with a first internal fastener located on the internal bottom surface and internal top surface of the each of the adjacent compartments, and wherein the first internal fastener comprises an opened and a closed position; wherein each of the adjacent compartments are releasably secured to each other with a first external fastener comprising an opened and a closed position, wherein the first external fastener is in the opened position the at least two adjacent compartments are at least partially separated from each other such that an opening is formed between the at least two adjacent compartments, and wherein the first external fastener is in the closed position, the opening formed between the at least two adjacent compartments is closed; and wherein access to the first internal fastener is allowed when the first external fastener is in the opened position.

Aspect 2: The pillow of Aspect 1, wherein the at least two adjacent compartments are in open communication with each other when the internal fastener is in the opened position and the external fastener is in the closed position.

Aspect 3: The pillow of Aspect 1 or 2, wherein a first of the at least two compartments comprises the amount of filler and wherein the pillow has a first height when the first internal fastener is in the closed position.

Aspect 4: The pillow of any one of Aspects 1-3, wherein the first and a second of the at least two compartments each comprises a portion of the amount of the filler and wherein the pillow has a second height when the first internal fastener is in the opened position and the first external fastener is in the closed position.

Aspect 5: The pillow of any one of Aspects 1-4, wherein the second height is lower than the first height.

Aspect 6: The pillow of any one of Aspects 1-5, wherein the cover further comprises a third compartment.

Aspect 7: The pillow of any one of Aspects 1-6, wherein the third compartment is configured to be releasably secured to a second compartment with a second internal fastener located on the internal bottom surface of the second compartment and internal top surface of the third compartment, wherein the second internal fastener comprises an opened and a closed position, and with a second external fastener comprising an opened and a closed position, wherein the second external fastener is in the opened position the second and the third compartments are at least partially separated from each other such that an opening is formed between the second and the third compartments, and wherein the second external fastener is in the closed position, the opening formed between the second and the third compartments is closed, and wherein access to the second internal fastener is allowed when the second external fastener is in the opened position.

Aspect 8: The pillow of any one of Aspects 1-7, wherein when the second internal fastener and the first internal fastener are in the opened position, and wherein the second external fastener, and the first external fastener are in the closed position, the third, the second, and a first of the at least three compartments each comprises a portion of the amount of the filler and wherein the pillow has a third height.

Aspect 9: The pillow of Aspect 7, wherein the third height is lower than the second and the first height.

Aspect 10: The pillow of any one of Aspects 1-9, wherein the first external fastener is a zipper, a hook and loop, a button, a snap, a hook and eye, a magnet, a grommet, a lace, a fabric tie, or any combination thereof.

Aspect 11: The pillow of any one of Aspects 1-10, wherein the first internal fastener is a zipper, a hook and loop, a button, a snap, a hook and eye, a magnet, a grommet, a lace, a fabric tie, or any combination thereof.

Aspect 12: The pillow of any one of Aspects 1-11, wherein the filler comprises a particulate material.

Aspect 13: The pillow of any one of Aspects 1-12, wherein the filler is contained in a bladder.

Aspect 14: A pillow comprising: a) a cover comprising a compartment defined by a top portion and a connected bottom portion, wherein the compartment comprises: i) a first section having a first length; and ii) at least one second section, adjacent to the first section along the axis of the first length, wherein the first section and the at least one second section are configured to be releasably secured with a first external fastener; wherein the first external fastener has an opened and a closed position; wherein the top portion has an internal top surface and an external top surface, and wherein the bottom portion has an internal bottom surface and an external bottom surface; wherein the at least one second section is defined by a gusset comprising a fabric sheet having a second length that is inwardly folded toward the top and bottom inner surfaces of the cover when the first external fastener is in the closed position; and wherein the fabric sheet is unfolded along the first length of the first section when the first external fastener is in the open position, such that a length of the compartment is a combination of the first and the second length; and b) an amount of filler.

Aspect 15: The pillow of Aspect 14, wherein the first external fastener is located along a width of the cover and is configured to form an opening between the first section and the at least one second section when is in the opened position.

Aspect 16: The pillow of any one of Aspects 14 or 15, wherein when the first external fastener is in the closed position, the first section comprises the amount of filler and wherein the pillow has a first height.

Aspect 17: The pillow of any one of Aspects 14-16, wherein when the first external fastener is in the opened position, each of the first section and the at least one second section comprises a portion of the amount of the filler and wherein the pillow has a second height.

Aspect 18: The pillow of any one of Aspects 14-17, wherein the second height is lower than the first height.

Aspect 19: A pillow cover comprising at least two adjacent compartments configured to be in open communication with each other; wherein each of the two of adjacent compartments are defined by a top portion and a bottom portion, wherein the top portion has an internal top surface and an external top surface, and wherein the bottom portion has an internal bottom surface and an external bottom surface; wherein the at least two adjacent compartments are configured to be releasably secured to each other with a first internal fastener located on the internal bottom surface and internal top surface of the each of the adjacent compartments, and wherein the first internal fastener comprises an opened and a closed position; wherein each of the adjacent compartments are releasably secured to each other with a first external fastener comprising an opened and a closed position, wherein the first external fastener is in the opened position the at least two adjacent compartments are at least partially separated from each other such that an opening is formed between the at least two adjacent compartments, and wherein the first external fastener is in the closed position, the opening formed between the at least two adjacent compartments is closed; and wherein access to the first internal fastener is allowed when the first external fastener is in the opened position, and wherein access to the first internal fastener is allowed when the first external fastener is in the opened position.

Aspect 20: A pillow cover comprising a compartment defined by a top portion and a connected bottom portion, wherein the compartment comprises: i) a first section having a first length; and ii) at least one second section, adjacent to the first section along the axis of the first length wherein the first section and the at least one second section are configured to be releasably secured with a first external fastener; wherein the first external fastener has an opened and a closed position; wherein the top portion has an internal top surface and an external top surface, and wherein the bottom portion has an internal bottom surface and an external bottom surface; wherein the at least one second section is defined by a gusset comprising a fabric sheet having a second length that is inwardly folded toward the top and bottom inner surfaces of the cover when the first external fastener is in the closed position; and wherein the fabric sheet is unfolded along the first length of the first section when the first external fastener is in the open position, such that a length of the compartment is a combination of the first and the second length.

What is claimed is:

1. A pillow comprising:

a) a cover comprising a compartment defined by a top portion and a connected bottom portion, wherein the compartment comprises:

i) a first section having a first length; and ii) at least one second section, adjacent to the first section along the axis of the first length, wherein the first section and the at least one second section are configured to be releasably secured with a first external fastener;

wherein the first external fastener has an opened and a closed position;

wherein the top portion has an internal top surface and an external top surface, and wherein the bottom portion has an internal bottom surface and an external bottom surface, wherein the internal top surface of the top portion and the internal bottom surface of the bottom portion define the compartment;

wherein the at least one second section is defined by a gusset comprising a fabric sheet having a second length that is inwardly folded within the compartment and toward the top and bottom inner surfaces of the cover when the first external fastener is in the closed position; and wherein the fabric sheet is unfolded along the first length of the first section when the first external fastener is in the open position, such that a length of the compartment is a combination of the first and the second length; and b) an amount of filler within the compartment.

2. The pillow of claim 1, wherein the first external fastener is located along a width of the cover and is configured to form an opening between the first section and the at least one second section when is in the opened position.

3. The pillow of claim 1, wherein when the first external fastener is in the closed position, the first section comprises the amount of filler and wherein the pillow has a first height.

4. The pillow of claim 1, wherein when the first external fastener is in the opened position, each of the first section and the at least one second section comprises a portion of the amount of the filler and wherein the pillow has a second height.

5. The pillow of claim 1, wherein the second height is lower than the first height.

6. The pillow of claim 1, wherein the first external fastener is located along the circumference of the cover.

7. The pillow of claim 1, wherein the first external fastener is a zipper, a hook and loop, a button, a snap, a hook and eye, a magnet, a grommet, a lace, a fabric tie, or any combination thereof.

8. The pillow of claim 1, wherein the at least one second section comprises two or more second sections.

9. The pillow of claim 8, wherein the two or more second sections are releasably secured to each other with a second and/or a third external fastener.

10. The pillow of claim 9, wherein the second and/or third external fastener has an open and a closed position.

11. The pillow of claim 10, wherein when the second external fastener is in the open position, the amount of filler is distributed between the first section and each of the subsequent second sections that are in open communication with each other, such that the pillow has a third height and/or a fourth height.

12. The pillow of claim 1, wherein the filler comprises a particulate material.

* * * * *